US006038414A

United States Patent [19]

Inami et al.

[11] Patent Number: 6,038,414

[45] Date of Patent: Mar. 14, 2000

[54] DEVELOPING APPARATUS WITH MAGNETIC SEALS FOR PREVENTING TONER LEAKAGE

[75] Inventors: Satoru Inami, Kashiwa; Junichi Kato, Toride; Toshiyuki Karakama, Shizuoka-ken; Atsushi Numagami, Hadano; Masahiro Yoshida; Yusuke Nakazono, both of Toride; Seiichi Shinohara, Abiko, all of Japan

[73] Assignee: Canon Kabushiki Kaisha, Tokyo, Japan

[21] Appl. No.: 09/179,579

[22] Filed: Oct. 27, 1998

[30] Foreign Application Priority Data

Oct. 30, 1997 [JP] Japan ..... 9-314324

[51] Int. Cl.[7] ..... G03G 15/08

[52] U.S. Cl. ..... 399/104

[58] Field of Search ..... 399/106, 102, 399/103, 104, 111, 222, 252, 258, 262, 265, 277, 279, 280, 284; 335/296, 302, 306

[56] References Cited

U.S. PATENT DOCUMENTS

| | | | |
|---|---|---|---|
| 5,084,733 | 1/1992 | Katoh et al. | 399/104 |
| 5,177,536 | 1/1993 | Watanabe et al. | 399/222 |
| 5,187,326 | 2/1993 | Shirai | 399/104 |
| 5,359,397 | 10/1994 | Yamaji | 399/277 |
| 5,790,923 | 8/1998 | Oguma et al. | 399/106 |
| 5,812,909 | 9/1998 | Oguma et al. | 399/103 |

*Primary Examiner*—Susan S. Y. Lee
*Assistant Examiner*—Hoan Tran
*Attorney, Agent, or Firm*—Fitzpatrick, Cella, Harper & Scinto

[57] ABSTRACT

A developing apparatus includes magnetic members, which are provided at ends of a developing agent bearing member with gaps therebetween and adapted to form magnetic seals between the magnetic members and the developing agent bearing member, are charged so that leakage between the magnetic seals and magnetic members, such as the developing agent bearing member, disposed in the vicinity of the magnetic seals is prevented.

27 Claims, 12 Drawing Sheets

6
25
3B
g
26
5
g
22
23
21
25

24
23
22
21

DEVELOPING APPARATUS WITH MAGNETIC SEALS FOR PREVENTING TONER LEAKAGE

BACKGROUND OF THE INVENTION

1. Field of the Invention

The present invention relates to a developing apparatus adapted to develop an electrostatic latent image and provided in an image forming apparatus of electrophotographic or electrostatic recording type such as a copying machine, a printer and the like.

2. Related Background Art

In electrophotographic image forming apparatuses for forming an image on a recording medium by using an electrophotographic process, an electrostatic latent image on an image bearing member has been developed with toner.

Developing apparatuses for effecting development have seal members for preventing a developing agent (toner) from flowing out in a longitudinal direction at both ends of a developing sleeve for bearing the developing agent. In the past, the seal members for preventing the toner flow-out have widely been formed from an elastomer such as felt, foam rubber, or the like. An example is shown in FIGS. 10 and 11.

FIG. 10 is a side sectional view showing a main part of a conventional developing apparatus incorporated into a process cartridge in which an image bearing member and a developing apparatus for developing an electrostatic latent image on the image bearing member are integrally housed and which can be detachably mounted to an image forming apparatus, and FIG. 11 is a sectional view showing a main part of a developing agent bearing member (developing sleeve).

As shown in FIGS. 10 and 11, a developing sleeve 5 includes a magnet roller 6 therein and is rotatably supported within a developing container 18 via sleeve bearings 12. Accordingly, toner 3 supplied from the developing container 18 is adhered to a surface of the developing sleeve 5 by a magnetic force of the magnet roller 6. After a thickness of a toner layer is regulated to a constant value by a developing blade (developing agent amount regulating member) 7, as the developing sleeve (developing agent bearing member) 5 is rotated, the toner is adhered to an electrostatic latent image on a photosensitive drum (not shown) at a position where the developing sleeve is opposed to the latent image, thereby effecting development.

At both longitudinal ends of the developing sleeve 5 outside of a developing area, elastic seal members 8 are provided at a side opposite to an open side of the development sleeve 5 mounted within the developing container 18. By urging the elastic seal members 8 against an outer peripheral surface of the developing sleeve 5, the toner 3 is prevented from leaking outside.

However, in the developing apparatus having such a construction, since the seal members 8 are urged against the peripheral surface of the developing sleeve 5 along about a half thereof, a great load is applied to the rotating developing sleeve 5 during the development, and the elastic seal members 8 are deteriorated due to contact between the seal members and the developing sleeve 5, thereby worsening sealing ability.

Further, if the toner enters between the development sleeve 5 and the elastic seal member(s) 8, torque or torque fluctuation will be increased to cause uneven rotation, thereby effecting a bad-influence upon image formation.

To solve these problems, it is known to provide a technique in which magnetic seal members are arranged at both longitudinal ends of the developing sleeve 5 with a predetermined gap between the seal members and the developing sleeve to prevent the flow-out of the toner.

FIG. 12 is a side sectional view of a developing apparatus using magnetic seal members. In FIG. 12, the magnetic seal members 21 are formed from magnets (magnetic field generating means) and are arranged at both longitudinal ends of the developing sleeve 5 with predetermined gaps between the seal members and an outer peripheral surface of the developing sleeve 5. In this condition, the magnetic seal members and the developing sleeve 5 are attached to the developing container 18.

As shown in FIG. 13, for example, in each magnetic seal member 21, N poles and S poles are alternately arranged on an inner surface of the seal member, and a gap g between the outer peripheral surface of the developing sleeve 5 and a surface of the magnetic seal member 21 is closed by a magnet brush generated by chains of toner particles formed along lines 24 of magnetic force, thereby preventing the toner from flowing out in the longitudinal direction of the developing sleeve 5.

As another conventional example, as shown in FIGS. 14 and 15, it is known to provide a technique in which a magnetic brush is formed by using a magnetic seal member 21 having side surfaces magnetized to N poles and S poles, respectively, or a magnetic seal member 21 having front and rear surfaces magnetized to N poles and S poles, respectively.

By using such techniques, since the magnetic seal members 21 can be disposed not to contact with the developing sleeve 5, the rotation torque of the developing sleeve 5 is greatly reduced. Accordingly, a compact and a cheaper drive motor can be used, and, since fluctuation of rotation torque becomes smaller so that uneven rotations of the developing sleeve 5 and the photosensitive drum are unlikely to occur, reduction of image quality due to such uneven rotations can be prevented. Further, since the magnetic seal member 21 is not worn, the magnetic seal member can be used substantially permanently and can be recycled.

However, the magnetic seal member 21 is charged by voltage applied to the developing sleeve or frictional charges existing between the developing sleeve and the magnetic seal member, with the result that charges are accumulated on the magnetic seal member. When the magnetic seal member includes metal to reduce electric resistance as mentioned above, namely, when the magnetic seal member has a small capacitance, high potential may be generated on the surface of the magnetic seal member. As a result, a leak occurs between the developing sleeve and the magnetic seal member, or, when a member having great potential difference with respect to the magnetic seal member is disposed in the vicinity of the magnetic seal member, a leak occurs between the members. Due to noise generated by such leaks, erroneous operation of the apparatus may occur. Particularly, it was found that, when volume resistivity of the magnets of the magnetic seal member is $10^5$ Ωcm or less and a distance between the magnetic seal member and the adjacent member is 3 mm or less, the leak is apt to occur.

SUMMARY OF THE INVENTION

An object of the present invention is to provide a developing apparatus which has a magnetic seal member and in which, when the magnetic seal member is charged, a leak can be prevented from occuring between the magnetic seal member and a member such as a developing agent bearing member disposed in the vicinity of the magnetic seal member and having great potential difference with respect to the magnetic seal member.

Another object of the present invention is to provide a developing apparatus which has a magnetic seal member and in which a leak is prevented by providing an insulating member between the magnetic seal member and a member such as a developing agent bearing member adjacent to the magnetic seal member to increase voltage required to generate discharging.

A further object of the present invention is to provide a developing apparatus which has a magnetic seal member and in which potential difference between the magnetic seal member and a developing agent bearing member is decreased by applying voltage to the magnetic seal member, thereby preventing leak.

The other objects and features of the present invention will be apparent from the following detailed explanation of the invention referring to the accompanying drawings.

DESCRIPTION OF THE PREFERRED EMBODIMENTS

The present invention will now be explained in connection with embodiments thereof with reference to the accompanying drawings.

FIGS. 1 to 5 show a developing apparatus according to an embodiment of the present invention, a process cartridge having such a developing apparatus, and an image forming apparatus to which such a process cartridge can be detachably be mounted.

[First Embodiment]

Figure 4:
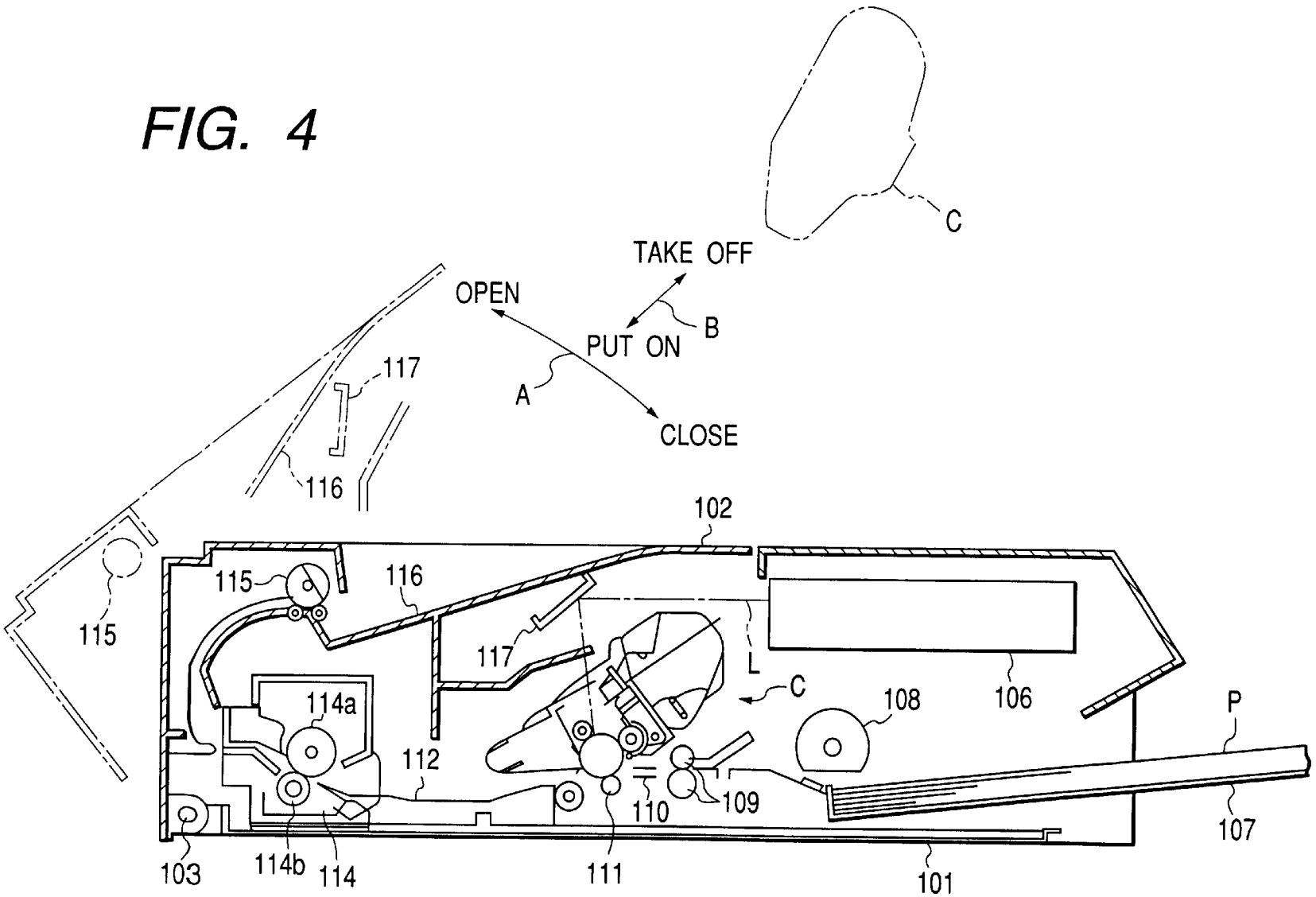
FIG. 4 is a constructural view showing an example of a process cartridge to which the present invention is applied.

FIG. 4 shows an example of a construction of an image forming apparatus using a process cartridge including a developing apparatus according to the present invention.

The image forming apparatus includes a lower frame 101, and an upper frame 102 openable with respect to the lower frame. The upper frame 102 is supported for rotation in a direction shown by the arrow A around hinge support shaft 103 at a rear side (left side in FIG. 4) of the lower frame 101 to be shifted between an open position (shown by the two dot and chain line in FIG. 4) and a closed position (shown by the solid line in FIG. 4). In the open position, a process cartridge C (described later) can be mounted and dismounted along directions shown by the arrow B.

At a front side (right side in FIG. 4) of the process cartridge C positioned at a predetermined position when the upper frame 102 is closed, a laser scanner unit 106 which is a main part of an exposure device is disposed, and, a transfer material cassette 107 for containing transfer materials P (onto which images are to be formed) is positioned below the laser scanner unit. At a downstream side of the transfer material cassette 107, along a conveying direction of the transfer material P, there are disposed a sheet supply roller 108, a pair of regist rollers 109, a transfer guide 110, a transfer charger 111, a convey member 112, and a fixing device 114 including a fixing roller 114*a* and a pressure roller 114*b*. Incidentally, all of these elements are housed within the lower frame 101.

On the other hand, a discharge roller 115 disposed at a downstream side of the fixing device 114, a sheet discharge tray 116, a reflection mirror 117 and the process cartridge C are positioned within the upper frame 102.

Figure 5:
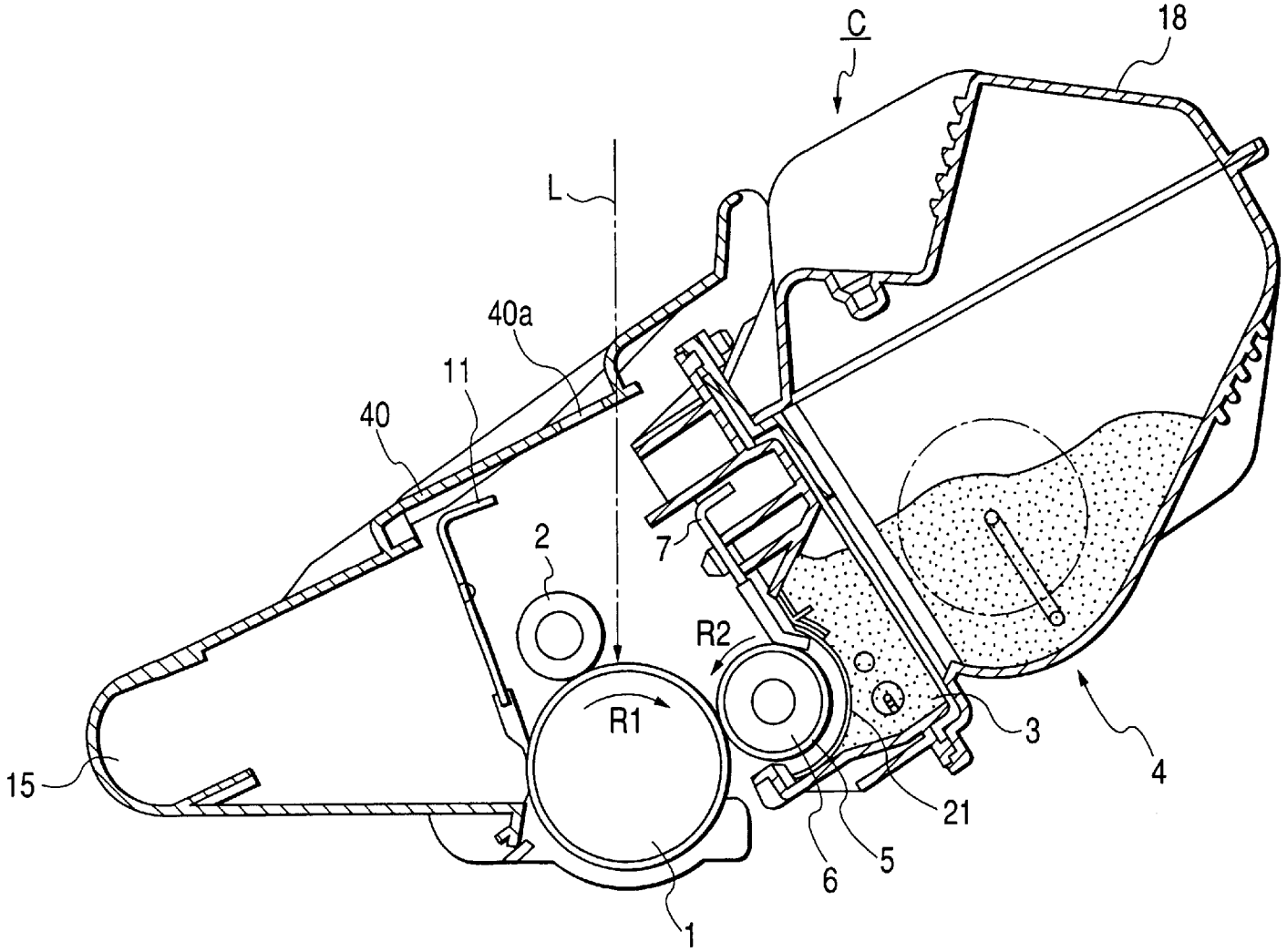
FIG. 5 is a constructural view showing an example of an image forming apparatus having the process cartridge of FIG. 4.

As shown in FIG. 5, in the process cartridge C, a cylindrical photosensitive drum (image bearing member) 1 rotated in a direction shown by the arrow R1, a charge roller (charge member) 2, a developing apparatus 4, and a cleaning device 15 including a cleaning member 11 (these constitute four process means) are integrally housed within a cartridge frame 40. Incidentally, the process cartridge C may include at least the photosensitive drum and the developing apparatus 4.

Next, the image formation will be explained briefly. The photosensitive drum 1 is rotated in the direction R1 at a predetermined peripheral speed (process speed). After a surface of the photosensitive drum 1 is uniformly charged by the charge roller 2, a latent image is formed by exposure light L.

An amount of toner 3 on a developing sleeve (developing agent bearing member) 5 is adjusted to a constant value by a developing blade (developing agent regulating member) 7, and the toner 3 is conveyed to a developing portion while being charged. At the developing portion where the toner 3 is opposed to the photosensitive drum 1, the toner is flying toward the latent image on the photosensitive drum 1 to be adhered thereto, thereby visualizing the latent image as a toner image.

On the other hand, the transfer materials P are supplied from the transfer material cassette 107 one-by-one by the sheet supply roller 108, and the supplied transfer material is supplied to a transfer position between the photosensitive drum 1 and the transfer charger 111 through the transfer guide 110 at a predetermined timing determined by the pair of regist rollers 109. Then, the toner image is transferred from the photosensitive drum 1 onto the transfer material P.

The transfer material P to which the toner image is transferred is separated from the photosensitive drum 1 and then is sent, by the convey member 112, to the fixing device 114, where, while the transfer material is being passed between the fixing roller 114*a* and the pressure roller 114*b*, fixing treatment for the toner image is effected. Thereafter, the transfer material is discharged onto the sheet discharge tray 116 by the discharge roller 115.

Figure 1:
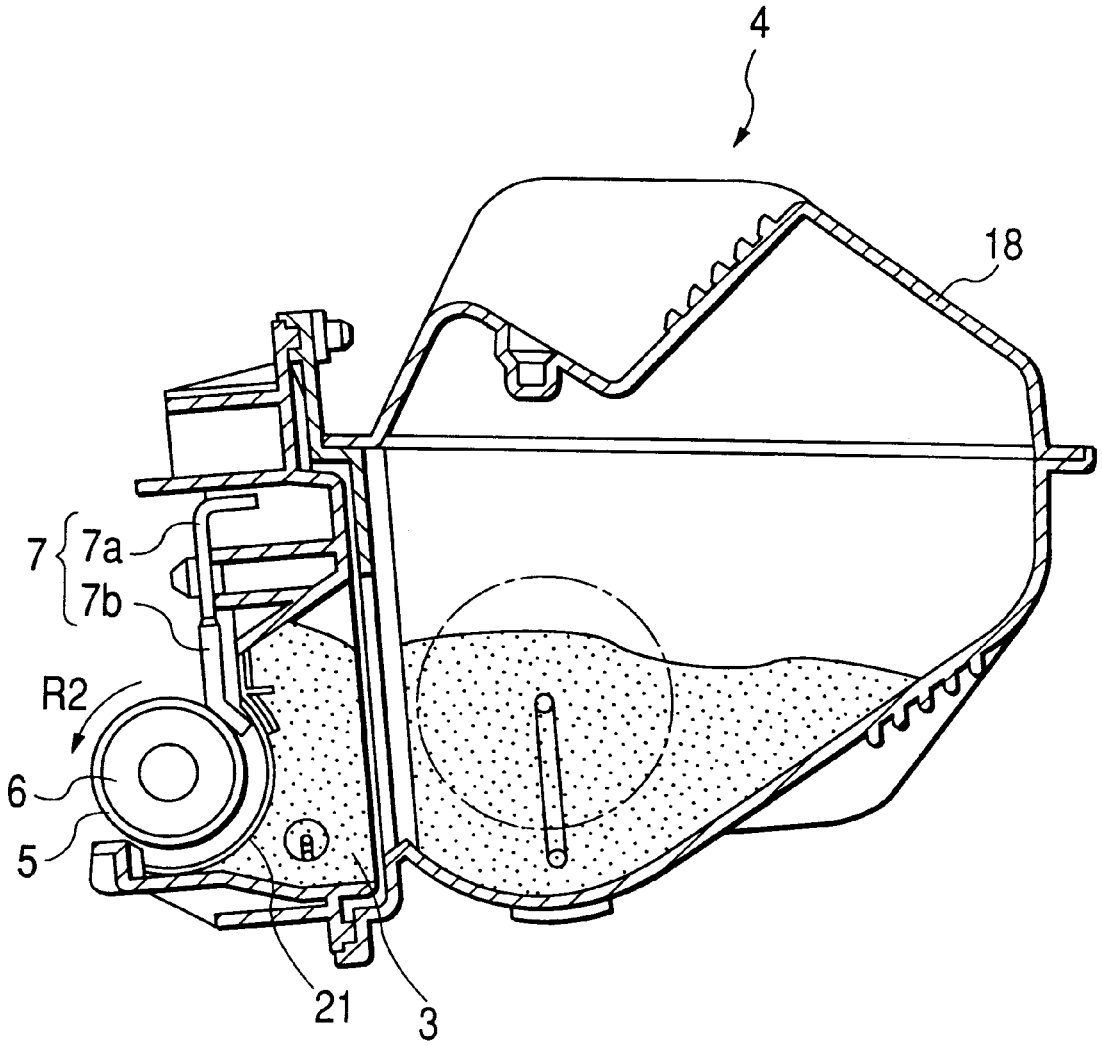
FIG. 1 is a side sectional view of a developing apparatus used in first to fourth embodiments of the present invention.

The developing apparatus 4 according to the embodiment shown in FIG. 1 forms a part of the process cartridge C and has a developing container 18 containing one-component magnetic toner 3. A developing sleeve 5 including a fixed magnet 6 therein is rotatably disposed at an opening portion of the developing container opposed to the photosensitive drum 1, and an elastic blade 7*b* is urged against the developing sleeve 5.

According to the illustrated embodiment, the developing sleeve 5 comprises an aluminium pipe having a diameter of 16 mm and is rotated in a direction shown by the arrow R2 in FIG. 1 at a peripheral speed of 50 mm/sec. The fixed magnet 6 in the developing sleeve 5 has four magnetic poles N1, S1, N2, S2 alternately arranged and having magnetic flux density of 75 mT.

The toner 3 in the developing container 18 is borne on the developing sleeve 5 by a magnetic force of the fixed magnet 6 and is regulated by the elastic blade 7*b* urged against the developing sleeve 5, thereby forming a toner layer having a predetermined thickness. As the developing sleeve 5 is rotated, the toner 3 in the toner layer is conveyed to the developing portion opposed to the photosensitive drum 1, where the toner is used for developing the latent image on the photosensitive drum 1.

Figure 2:
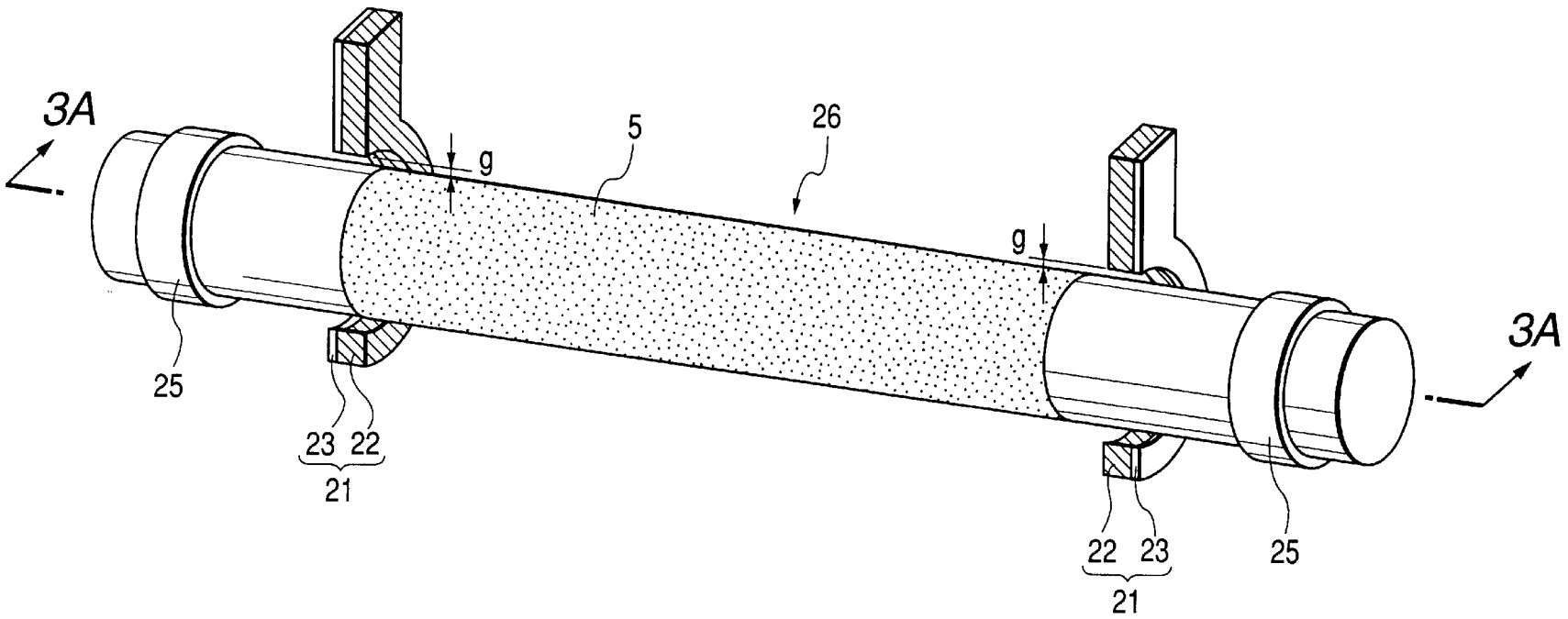
FIG. 2 is a perspective view of a developing sleeve and magnetic seal members of the first to fourth embodiments.
Figure 3A:
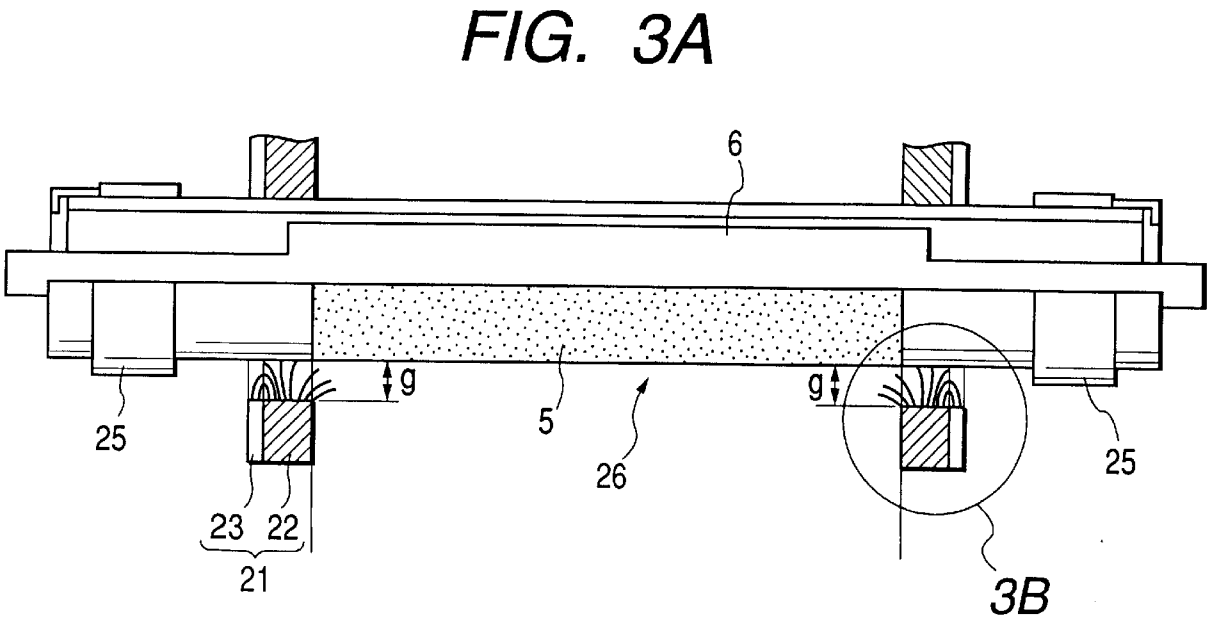
FIG. 3A is a sectional view of the magnetic seal members of FIG. 2, taken along the line 3A—3A in FIG. 2, and FIG. 3B are enlarged view showing 3B portion in FIG. 3A.
Figure 3B:
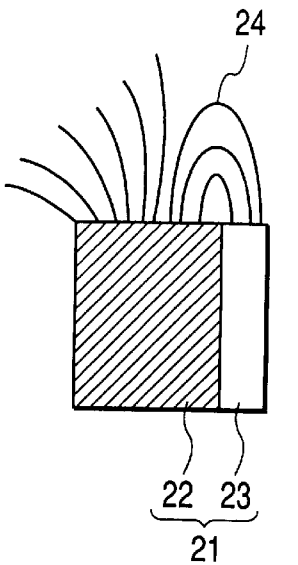

Magnetic seal members 21 are disposed at both ends of the developing sleeve 5. FIG. 2 is a perspective view showing the developing sleeve 5 and the magnetic seal members 21.

Each magnetic seal member 21 is positioned adjacent to the outer peripheral surface of the developing sleeve 5 with a gap g therebetween and is attached to the developing container 18.

Each magnetic seal member 21 is constituted by a magnet 22 and a magnetic member 23 (magnetic field generating means). The magnet 22 is an injection-molded part having nylon binder including Nd—Fe—B magnetic powder and having a width of 3 mm and having volume resistivity of $10^5$ Ωcm or less, and the magnetic member 23 is formed from iron material having a thickness of 1 mm.

The gap g between the developing sleeve 5 and the magnetic seal member 21 is selected to 0.1 to 0.7 mm so that magnetic flux density on the developing sleeve 5 caused by the magnetic seal member 21 is 100 to 200 mT. A positional relation between the magnet 22 and the magnetic member 23 in the magnetic seal member 21 is selected so that the magnet 22 is disposed adjacent to an opening portion 26 (hatched central portion on the developing sleeve in FIG. 2) of the developing container 18 and the magnetic member 23 is disposed outside (both longitudinal ends of the developing sleeve in FIG. 2) of the opening portion 26.

By arranging the magnet 22 adjacent to the opening portion 26 and magnetic member 23 outside of the opening portion 26 as mentioned above, as shown in FIG. 3B (enlarged view showing a portion 3B in FIG. 3A), since lines 24 of magnetic force of the magnetic seal members 21 extended and held along the magnets 22, the toner 3 does not leak out of the magnetic seal members 21, thereby providing excellent sealing ability.

Next, characteristic portions of the illustrated embodiment will be described.

In order to prevent leakage between two parts, it is effective to increase resistance between the parts to increase voltage required to generate the leak. To this end, in the illustrated embodiment, as shown in FIG. 6, by covering surfaces of the magnetic seal members 21 opposed to the developing sleeve 5 by insulation members, potential difference required to cause a leak between the developing sleeve 5 and the magnetic seal members 21 is further increased, thereby preventing the leak.

Figure 6:
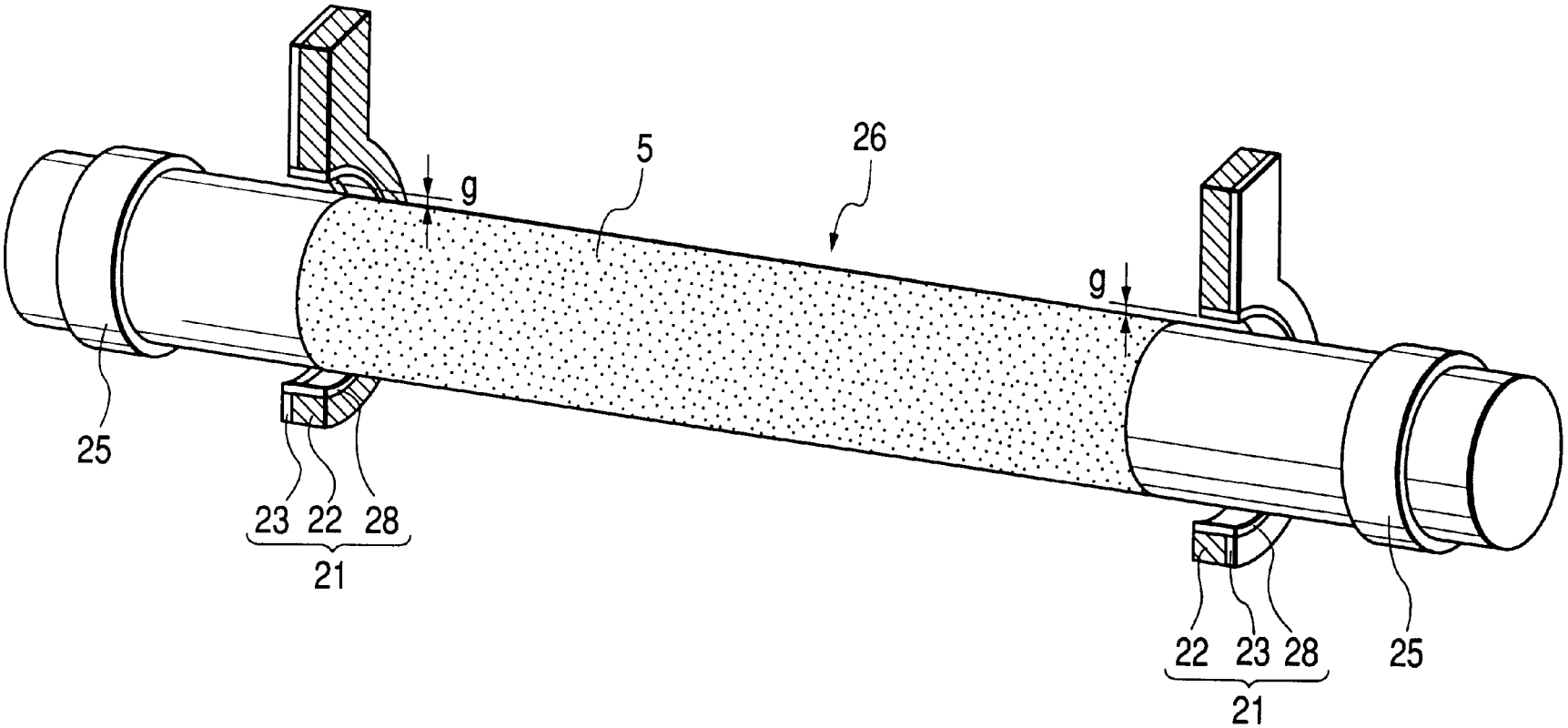
FIG. 6 is a perspective view showing a developing sleeve and magnetic seal members according to a first embodiment.

FIG. 6 is a perspective view of the magnetic seal members 21 according to this embodiment.

Each magnetic seal member 21 is constituted by a magnet 22, a magnetic member 23, and an insulation member 28. The magnet 22 is disposed inside of a longitudinal direction of the insulation member 28 and the magnetic member 23 is disposed outside of the longitudinal direction of the insulation member 28. The magnet 22 is an injection-molded part having nylon binder including Nd—Fe—B magnetic powder and having a width of 3 mm and having volume resistivity of $10^5$ Ωcm or less, and the magnetic member 23 is formed from iron material having a thickness of 1 mm.

A surface of each magnetic seal member 21 opposed to the developing sleeve 5 is coated by an insulation layer formed from fluororesin coat 28 having a thickness of 100 μm. The insulation layer may be made of other phenol group, silicon group or polyurethane group and so on.

Since a construction of the developing apparatus according to the illustrated embodiment is the same as that shown in FIG. 1, explanation thereof will be omitted.

By using the magnetic seal members 21 having the above-mentioned construction, when there is no insulation layer 28, it was ascertained that noise is generated; however, when the insulation layers 28 are provided, it was found that no noise is generated.

Since the construction according to the illustrated embodiment as mentioned above does not depend upon resistance of the magnets and magnetic members of the magnetic seal members 21, cheaper materials or materials having high magnetic force can freely be selected and used.

Figure 7:
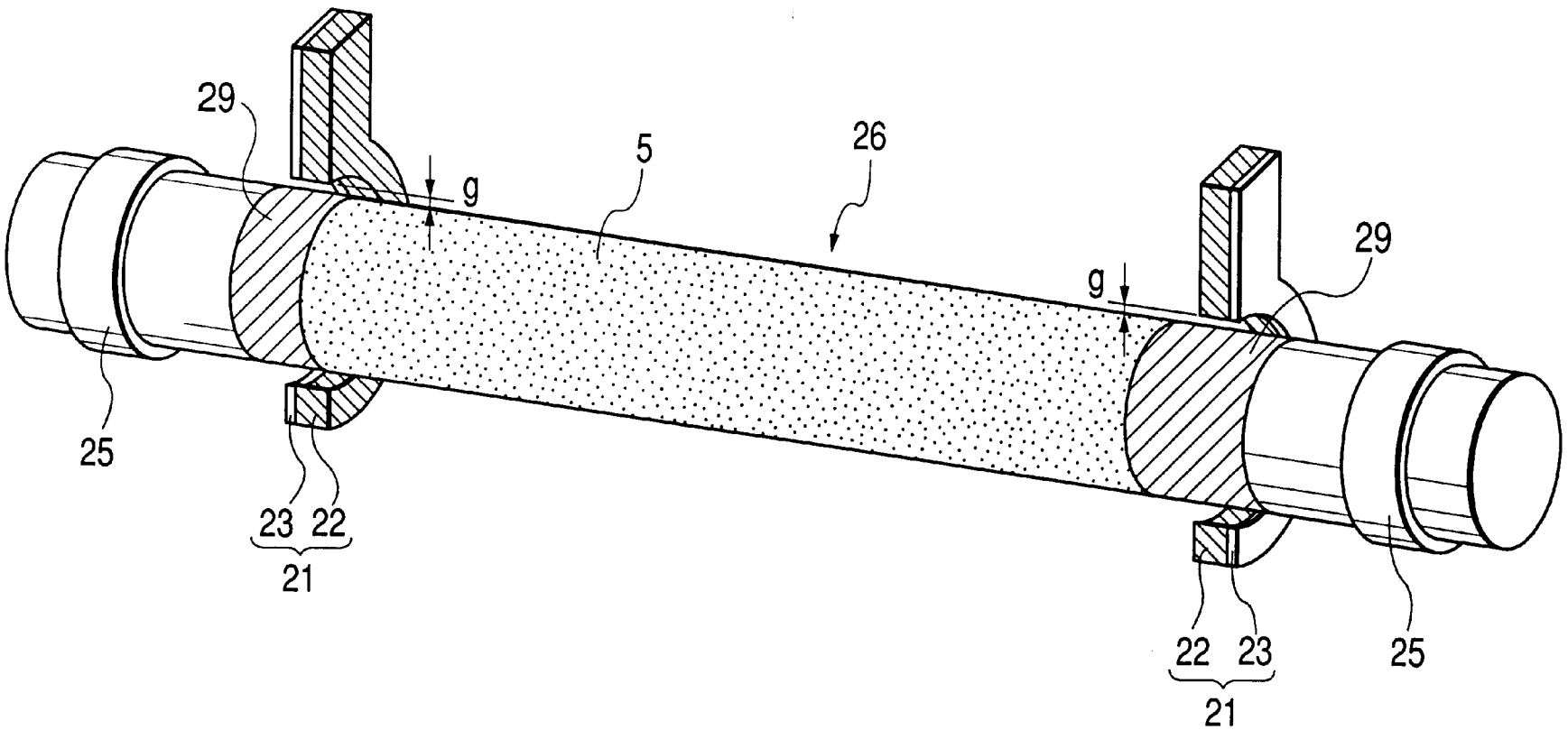
FIG. 7 is a perspective view showing a developing sleeve and magnetic seal members according to a second embodiment.

Next, a second embodiment of the present invention will be explained with reference to FIG. 7. FIG. 7 is a perspective view showing a developing sleeve 5, magnetic seal members 21, and spacer sub-rollers 25 in the second embodiment.

In the first embodiment, while the insulation layers 28 are provided on the surfaces of the magnetic seal members 21 in the developing apparatus 4 shown in FIG. 1, in the second embodiment, insulation layers 29 are provided on surface portions of the developing sleeve 5 opposed to the magnetic seal members 21.

Similar to the first embodiment, since the potential difference required to cause a leak between the magnetic seal members 21 and the developing sleeve 5 can be increased, the leak can be prevented.

In the illustrated embodiment, a width of each magnetic seal member 21 is selected to 4 mm, the insulation layer 29 having a width of 6 mm (greater than that of the magnetic seal member by 1 mm at left and right, respectively) is provided on the surface portion of the developing sleeve 5 opposed to each magnetic seal member. The reason is that, by increasing a minimum distance between an area on the developing sleeve 5 having no insulation layer 29 and each magnetic seal member 21, the leak preventing ability is enhanced.

Each insulation layer 29 is formed from a silicone tape having a thickness of 80 μm. The positional relation between the magnet 22 and the magnetic member 23 of each magnetic seal member 21 is the same as that in the first embodiment.

Since a construction of the developing apparatus according to the illustrated embodiment is the same as that shown in FIG. 1, an explanation thereof will be omitted.

In the developing sleeve 5 and the magnetic seal members 21 having the above-mentioned construction, when there is no insulation layer 29 on the outer peripheral surface of the developing sleeve 5, it was ascertained that noise is generated. However, it was found that no noise is generated by providing the insulation layers 29 in the manner described above.

For example, similar to the first embodiment, since the construction according to the illustrated embodiment as mentioned above does not depend upon resistance of the magnets and magnetic members of the magnetic seal members 21, cheaper materials or materials having high magnetic force can freely be selected and used.

Figure 8:
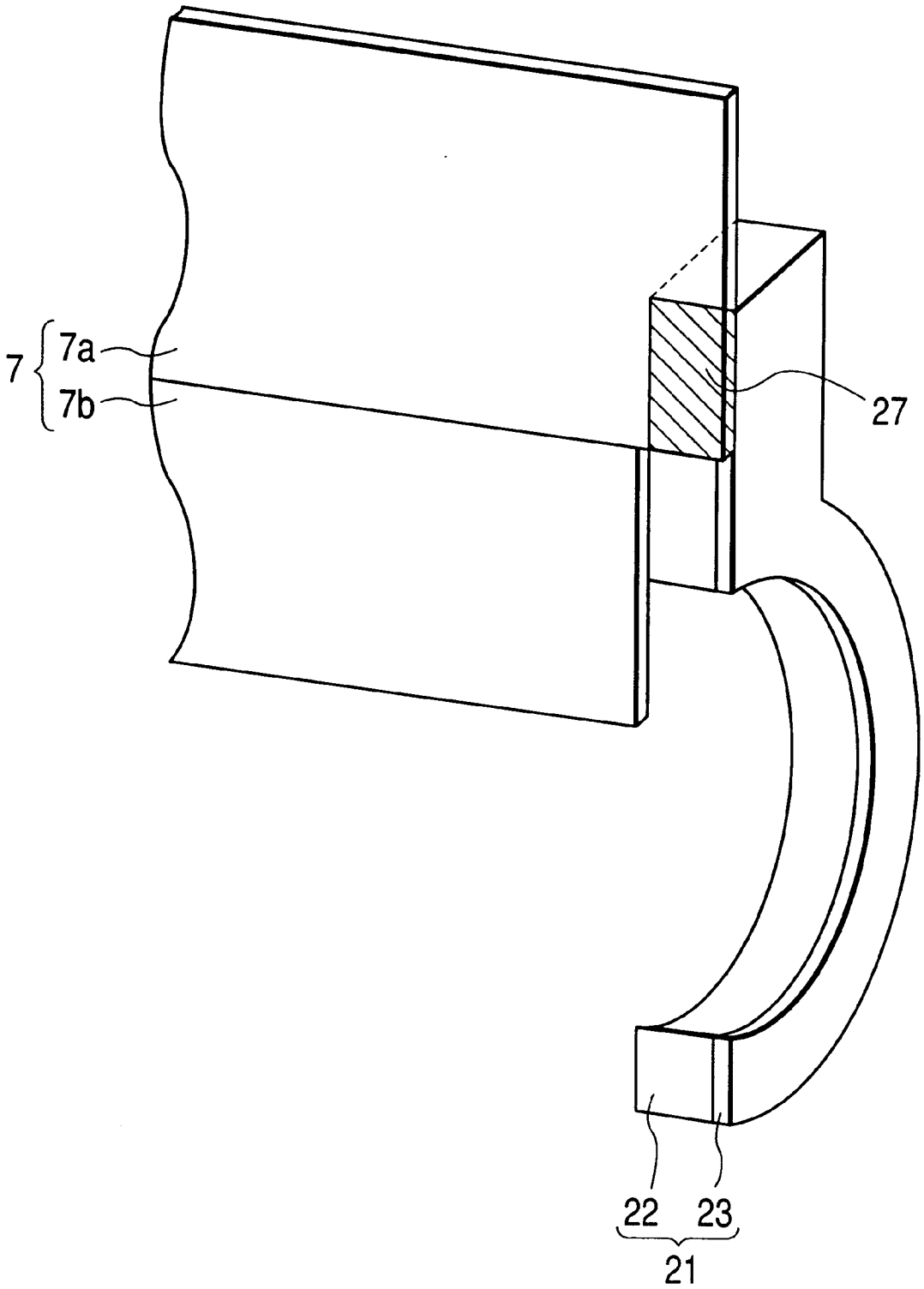
FIG. 8 is a perspective view showing a developing blade and a magnetic seal member according to a third embodiment.

Next, a third embodiment of the present invention will be explained with reference to FIG. 8. FIG. 8 is a perspective view showing a developing sleeve 5, a developing blade 7 and a magnetic seal member 21 in the third embodiment.

If a conductive member having great potential difference with respect to a magnetic seal member is located in the vicinity of the charged magnetic seal member, a leak may occur between the conductive member and the magnetic seal member. Particularly, when a distance between these members is 3 mm or less, the leak is apt to occur. An example of such a conductive member is a support member for supporting the developing blade.

According to the third embodiment, in the developing apparatus 4 shown in FIG. 1, at an area where a support member 7*a* of a developing blade 7 made of metal or conductive material and the magnetic seal member 21 are opposed to each other, by arranging an insulation member 27 between the support member 7*a* of the developing blade 7 and the magnetic seal member 21, generation of noise due to possible leak between the support member 7*a* of the developing blade 7 and the magnetic seal member 21 is prevented.

FIG. 8 is a perspective view showing the magnetic seal member 21 and a portion of the developing blade 7.

The magnetic seal member 21 and the developing blade 7 are disposed adjacent to each other and are attached to the developing container 18 (not shown in FIG. 8).

The magnetic seal member 21 includes a magnet 22 and a magnetic member 23, similar to the first embodiment.

The developing blade 7 comprises an elastic blade 7*b* made of urethane rubber, silicone rubber, or the like, and the support member 7*a* made of aluminium, stainless steel or the like.

As shown in FIG. 8, at the area where the support member 7*a* of the developing blade 7 is overlapped with the magnetic seal member 21, a polyethylene terephthalate (PET) film having a thickness of 50 $\mu$m and constituting the insulation member 27 is provided between the support member 7*a* of the developing blade 7 and the magnetic seal member 21. The insulation member 27 may be formed from a polyimide film, a polyethylene group film or the like, as well as the PET film.

Further, at the area where the support member 7*a* of the developing blade 7 and the magnetic seal member 21 are opposed to and adjacent to each other, an insulation film may previously coated on at least one of the support member 7*a* and the magnetic seal member 21.

More specifically, an insulation coat is coated on a portion of the magnetic seal member 21 abutting against the support member 7*a* by acrylic electroplating. Further, insulative coat material is coated on a portion of the support member 7*a* abutting against the magnetic seal member 21. Alternatively, since the developing blade 7 is made of urethane rubber, silicone rubber, or the like as mentioned above, by abutting a portion of the rubber against the magnetic seal member 21, insulation between the support member 7*a* and the magnetic seal member 21 may be achieved.

By effecting the above-mentioned insulating method, not only a noise problem (described later) can be solved, but also the increase in the number of parts and the number of assembling steps for countermeasure to the noise problem can be prevented, thereby preventing an increase in cost.

Since a construction of the developing apparatus according to the illustrated embodiment is the same as that shown in FIG. 1, an explanation thereof will be omitted.

With the arrangement as mentioned above, when radiation noise measurement (RFI measurement) was effected, it was ascertained that, when the support member 7*a* of the developing blade 7 is directly contacted with the seal member 21, noise is generated, but, in the construction according to the illustrated embodiment, noise is not generated.

Next, a fourth embodiment of the present invention will be explained. In the above-mentioned embodiments, while a leak is prevented by increasing the resistance by using the insulation members, the leak can be prevented by decreasing potential difference between two members. Particularly, if there is no potential difference, since there is no leak, it is desirable that voltages applied to two members have same waveforms and same phases.

In the fourth embodiment, by applying a voltage having the same waveform and phase as the bias voltage applied to the developing sleeve to the magnetic seal members, the surface potential of each magnetic seal member is made equal to the surface potential of the developing sleeve, thereby preventing leakage.

Figure 9:
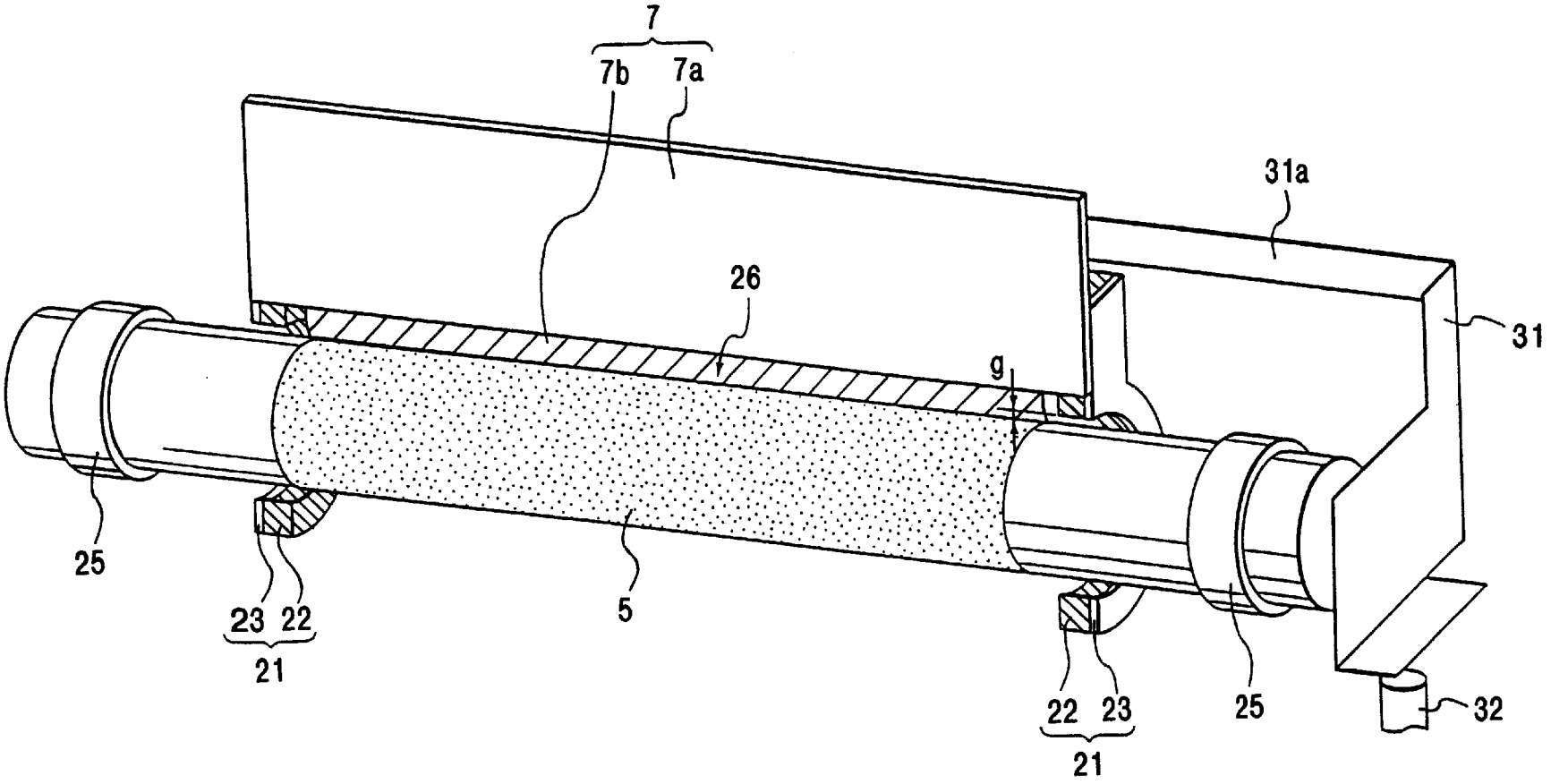
FIG. 9 is a perspective view showing a developing blade, magnetic seal members and an electrode member according to a fourth embodiment.
Figure 10:
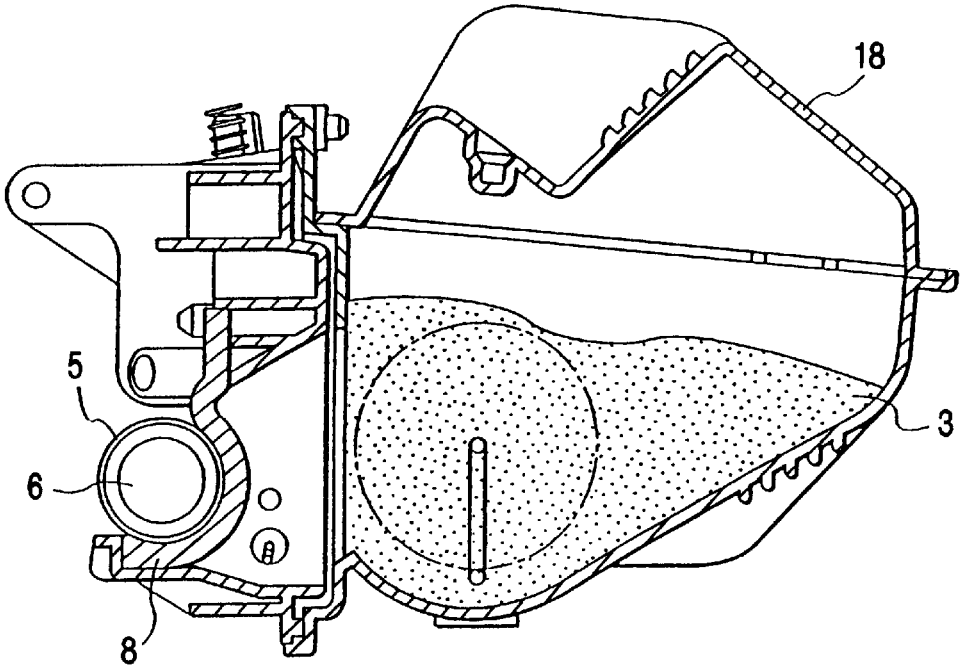
FIG. 10 (PRIOR ART)
FIG. 10 is a side sectional view showing an example of a conventional developing apparatus.
Figure 11:
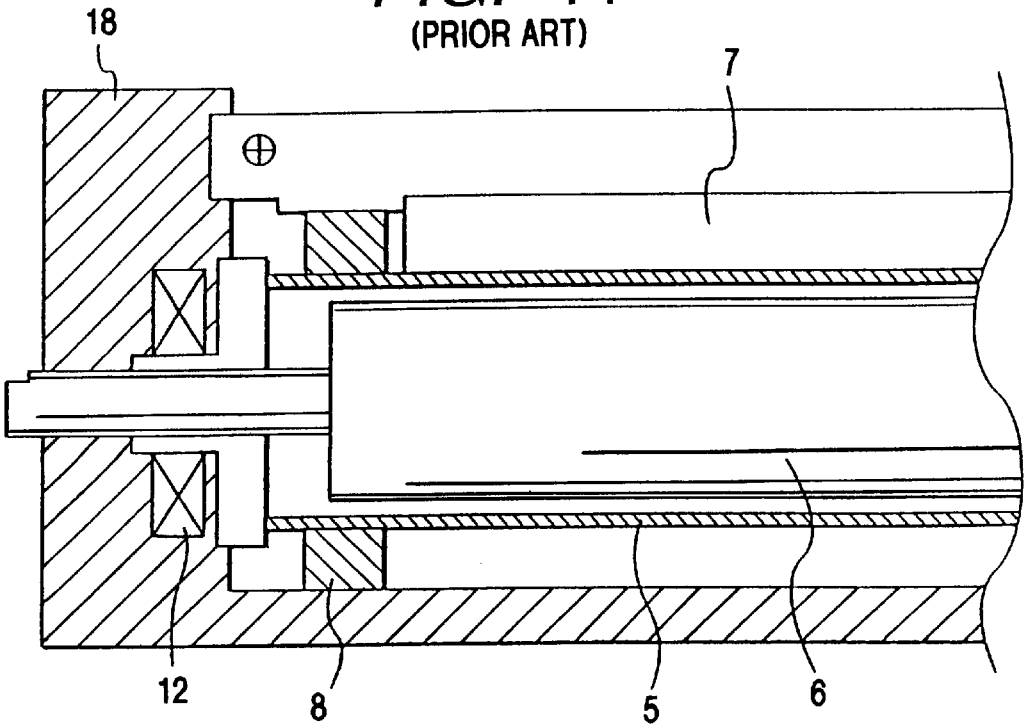
FIG. 11 (PRIOR ART)
FIG. 11 is a sectional view showing an elastic seal member of FIG. 10 and therearound.
Figure 12:
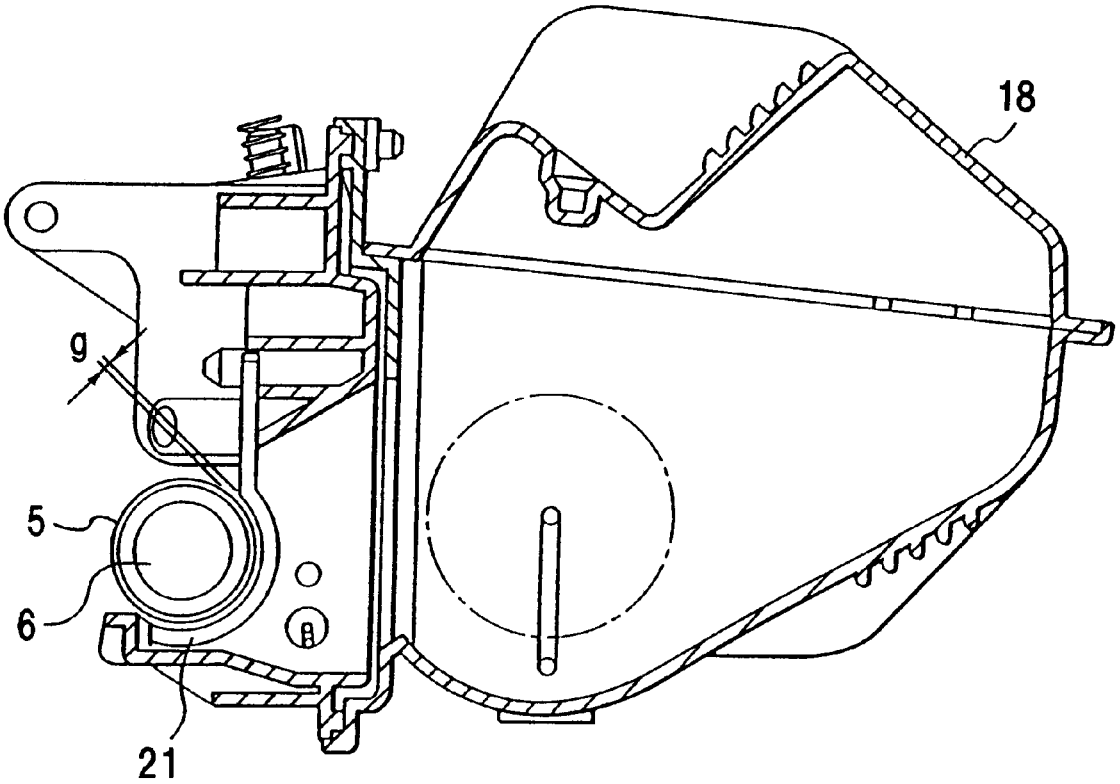
FIG. 12 (PRIOR ART)
FIG. 12 is a side sectional view showing an example of a developing apparatus using magnetic seal members.
Figure 15:
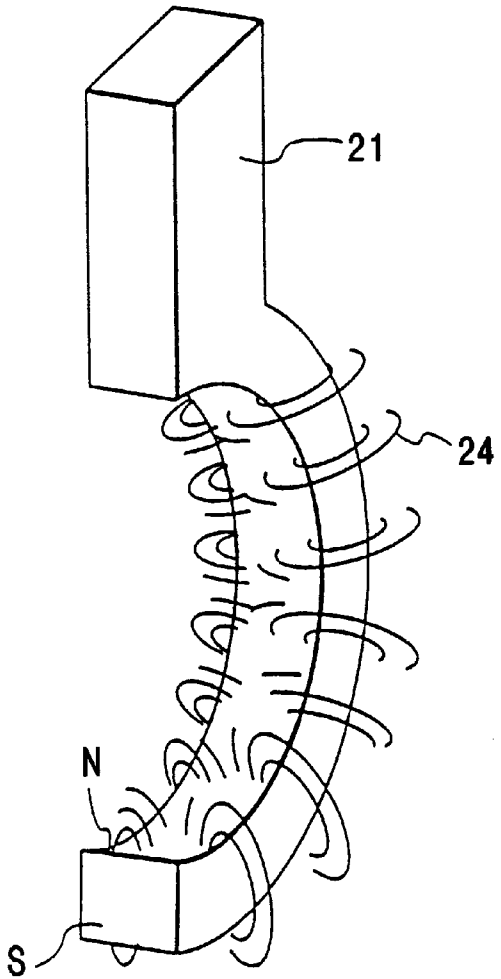
FIG. 15 (PRIOR ART)
FIG. 15 is an explanatory view showing a further example of a magnetic pattern of the magnetic seal member.
Figure 14:
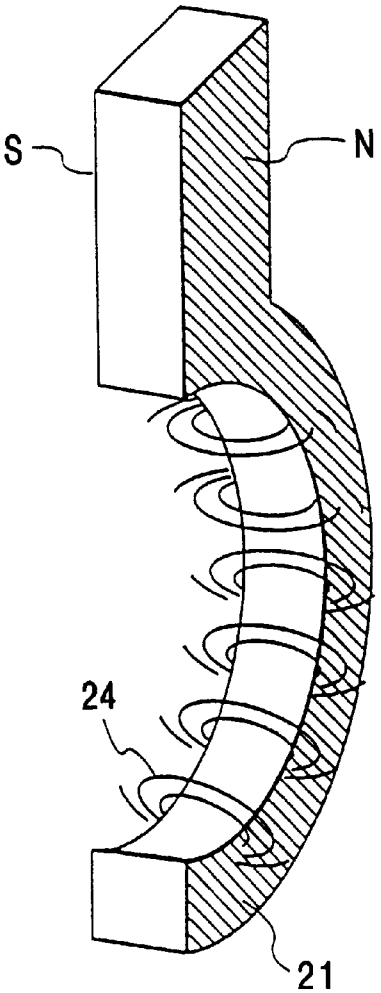
FIG. 14 (PRIOR ART)
FIG. 14 is an explanatory view showing another example of a magnetic pattern of the magnetic seal member.
Figure 13:
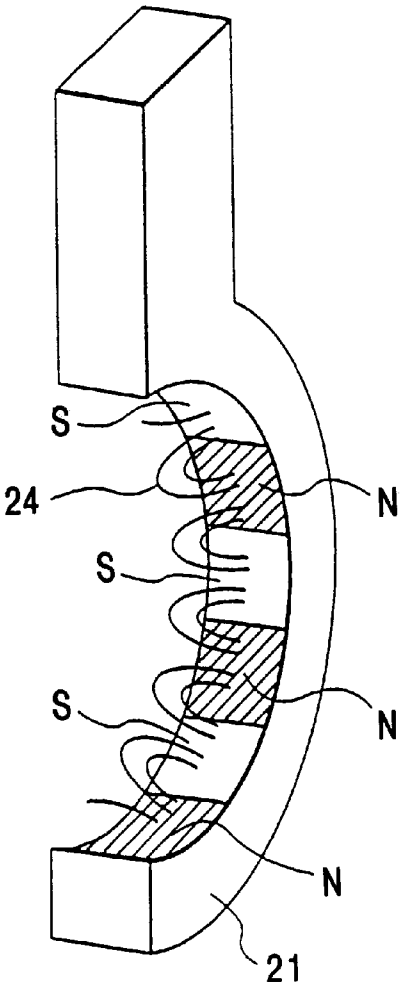
FIG. 13 (PRIOR ART)
FIG. 13 is an explanatory view showing an example of a magnetic pattern of the magnetic seal member.

FIG. 9 shows the fourth embodiment.

A developing blade 7 comprises a support member 7*a* made of metal, and an elastic member 7*b* made of rubber and adapted to regulate the toner.

In FIG. 9, voltage supplied from the image forming apparatus is supplied to the developing sleeve 5 and the support member 7*a* of the developing blade 7 through a terminal 32 and an electrode plate 31 of the developing apparatus contacted with the terminal 31. The electrode plate 31 and the developing sleeve 5 is interconnected by a metallic spring (not shown), and an extension 31*a* of the electrode plate 31 is connected and secured to a rear surface of the support member 7*a* of the developing blade 7.

The voltage supplied from the image forming apparatus to the developing sleeve 5 and the support member 7*a* of the developing blade 7 may be only DC voltage or (DC+AC) voltage, and, in the illustrated embodiment, a rectangular wave form having DC voltage of −650 V and AC voltage of 2000 Hz and 1600 V (=Vpp) is applied. The voltage having the same waveform and phase as those of the voltage applied to the developing sleeve 5 is applied to each magnetic seal member 21 through the support member 7*a* of the developing blade 7 so that the potential of the seal member is made equal to that of the developing sleeve 5.

By using the developing apparatus according to this embodiment, the radiation noise measurement (RFI measurement) was effected in a radio wave shielding room.

It was ascertained that the noise is not generated by making the surface potential of each magnetic seal member 21 equal to the surface potential of the developing sleeve 5. That is to say, it was ascertained that there is no leak between the magnetic seal members 21 and the developing sleeve 5.

Further, if there is potential difference between the developing sleeve 5 and the magnetic seal members 21 and the support member 7*a* of the developing blade 7, the charged toner 3 is apt to be collected in the vicinity of the magnetic seal member 21 and the support member 7*a* of the developing blade 7, with the result that circulation of the toner 3 in the developing container 18 is prevented to reduce the toner density. However, in the illustrated embodiment, since there is no part for generating the potential difference in the developing container 18, the toner can be circulated smoothly, so that an image having high quality can be outputted with stable density.

As mentioned above, in the illustrated embodiment, a leak between the developing sleeve 5 and the magnetic seal members 21 can be prevented by making the surface potentials of the magnetic seal members 21 equal to the surface potential of the developing sleeve 5, and further, good toner circulation can be achieved to stabilize the toner density.

Incidentally, by applying the developing apparatus to the process cartridge, the following advantage can be obtained. That is to say, in the process cartridge which is frequently mounted and dismounted with respect to the image forming apparatus, many electrical contacts for contacting with contacts of the image forming apparatus are provided, so that noise is apt to generated from the contacts. Thus, even if noise from each contact is small, the total noise may lead to erroneous operation of the image forming apparatus.

The fact that the present invention is applied to the process cartridge and the leak is prevented is very useful for the stable operation of the image forming apparatus.

As mentioned above, while the present invention was explained in connection with embodiments thereof, the present invention is not limited to such embodiments, but various alterations can be made within the scope of the invention.

What is claimed is:

1. A developing apparatus comprising:

a developing container for containing a magnetic developing agent;

a developing agent bearing member for bearing and conveying the magnetic developing agent from said developing container to a developing position;

a magnetic member provided so as to be opposed to an end of said developing agent bearing member with a gap therebetween to form a magnetic seal between said magnetic member and said developing agent bearing member;

a conductive member disposed in the vicinity of said magnetic member; and an insulation member provided between said magnetic member and said conductive member for electrically insulating said magnetic member from said conductive member.

2. A developing apparatus according to claim 1, wherein a surface of said magnetic member near said conductive member is covered by said insulation member.

3. A developing apparatus according to claim 1, wherein a surface of said conductive member near said magnetic member is covered by said insulation member.

4. A developing apparatus according to claim 1, wherein volume resistivity of said insulation member is greater than volume resistivity of said magnetic member.

5. A developing apparatus according to claim 1, wherein said magnetic member has a magnet including Nd—Fe—B powder.

6. A developing apparatus according to claim 1, wherein said magnetic member is electrically floating.

7. A developing apparatus according to claim 1, further comprising a developing agent amount regulating member for regulating an amount of the developing agent on said developing agent bearing member, wherein said conductive member supports said developing agent amount regulating member.

8. A developing apparatus according to claim 7, wherein said insulation member is is in contact with both said conductive member and said magnetic member.

9. A developing apparatus according to claim 1, wherein said developing apparatus is constituted together with an image bearing member for bearing an electrostatic latent image as a unit which can detachably be mounted to an image forming apparatus.

10. A developing apparatus comprising:

a developing container for containing magnetic developing agent;

a developing agent bearing member for bearing and conveying the magnetic developing agent from said developing container to a developing position and to which bias voltage is applied;

a magnetic member provided so as to be opposed to an end of said developing agent bearing member with a gap therebetween to form a magnetic seal between said magnetic member and said developing agent bearing member; and an insulation member provided between said magnetic member and said developing agent bearing member for electrically insulating said magnetic member from said developing agent bearing member.

11. A developing apparatus according to claim 10, wherein a surface of said magnetic member near said developing agent bearing member is covered by said insulation member.

12. A developing apparatus according to claim 10, wherein a surface of said developing agent bearing member near said magnetic member is covered by said insulation member.

13. A developing apparatus according to claim 10, wherein volume resistivity of said insulation member is greater than volume resistivity of said developing agent bearing member and said magnetic member.

14. A developing apparatus according to claim 10, wherein said magnetic member has a magnet including Nd—Fe—B powder.

15. A developing apparatus according to claim 10, wherein the bias voltage has a wave form obtained by overlapping AC voltage and DC voltage together.

16. A developing apparatus according to claim 10, wherein said developing apparatus is constituted together with an image bearing member for bearing an electrostatic latent image as a unit which can detachably be mounted to an image forming apparatus.

17. A developing apparatus comprising:

a developing container for containing magnetic developing agent;

a developing agent bearing member for bearing and conveying the magnetic developing agent within said developing container and to which bias voltage is applied;

a magnetic member provided at an end of said developing agent bearing member with a gap therebetween to form a magnetic seal between said magnetic member and said developing agent bearing member; and a voltage applying means for applying bias voltage to said magnetic member so that potential of said magnetic member becomes substantially the same as potential of said developing agent bearing member.

18. A developing apparatus according to claim 17, wherein the bias voltage obtained by overlapping AC voltage and DC voltage together is applied to said developing agent bearing member, and the voltage having substantially the same wave form and phase as those of the bias voltage is applied to said magnetic member.

19. A developing apparatus according to claim 17, further comprising a common power source for applying the bias voltages to said magnetic member and said developing agent bearing member.

20. A developing apparatus according to claim 17, further comprising a regulating member for regulating an amount of the developing agent on said developing agent bearing member, and a support member having conductivity for supporting said regulating member, wherein said voltage applying means applies bias voltage to said support member.

21. A developing apparatus according to claim 20, wherein said voltage applying means applies the bias voltage to said magnetic member through said support member.

22. A developing apparatus according to claim 17, wherein said magnetic member has a magnet including Nd—Fe—B powder.

23. A developing apparatus according to claim 17, wherein said developing container and said developing agent bearing member and said magnetic member are integrally formed together with an image bearing member for bearing an electrostatic latent image and can detachably be mounted to an image forming apparatus.

24. A developing apparatus comprising:

a developing container for containing a magnetic developing agent;

a developing agent bearing member for bearing and conveying the magnetic developing agent from said developing container to a developing position, wherein a bias voltage is applied to said developing agent bearing member;

a magnetic member provided so as to be opposed to an end of said developing agent bearing member to form a magnetic seal between said magnetic member and said developing agent bearing member;

an electrode member for electrically connecting said magnetic member with said developing agent bearing member so that a potential of said magnetic member becomes substantially the same as a potential of said developing agent bearing member.

25. A developing apparatus according to claim 24, further comprising a regulating member for regulating an amount of the developing agent on said developing agent bearing member, and a support member having conductivity for supporting said regulating member, wherein said electrode member is in contact with said support member.

26. A developing apparatus according to claim 24, wherein said magnetic member has a magnet including Nd—Fe—B powder.

27. A developing apparatus according to claim 24, wherein said developing apparatus comprises an image bearing member for bearing an electrostatic latent image, which can detachably be mounted to an image forming apparatus, as a unit.

* * * * *

UNITED STATES PATENT AND TRADEMARK OFFICE

CERTIFICATE OF CORRECTION

PATENT NO. : 6,038,414

DATED : March 14, 2000

INVENTOR(S) : SATORU INAMI, ET AL.

It is certified that error appears in the above-identified patent and that said Letters Patent is hereby corrected as shown below:

COLUMN 1
Line 51, "ment" should read --ing--, and
Line 64, "development" should read --developing--.

COLUMN 2
Line 67, "occuring" should read --occurring--.

COLUMN 3
Line 30, "are" should read --is an--.

COLUMN 4
Line 5, "be" should be deleted.

COLUMN 5
Line 19, "aluminium" should read --aluminum--.

UNITED STATES PATENT AND TRADEMARK OFFICE

CERTIFICATE OF CORRECTION

PATENT NO. : 6,038,414

DATED : March 14, 2000

INVENTOR(S) : SATORU INAMI, ET AL.

It is certified that error appears in the above-identified patent and that said Letters Patent is hereby corrected as shown below:

COLUMN 7

Line 50, "aluminium," should read --aluminum,--, and

Line 64, "coated" should read --be coated--.

COLUMN 8

Line 45, "is" should read --are--, and

Line 53, "wave form" should read --waveform--.

COLUMN 9

Line 24, "generated" should read --be generated--.

COLUMN 10

Line 8, "is is" should read --is--.

Signed and Sealed this

Seventeenth Day of April, 2001

*Attest:*

Nicholas P. Godici

NICHOLAS P. GODICI

*Attesting Officer*

*Acting Director of the United States Patent and Trademark Office*